US010102843B1

(12) United States Patent
Le et al.

(10) Patent No.: US 10,102,843 B1
(45) Date of Patent: Oct. 16, 2018

(54) MULTI PROFILE HEARING PROTECTION HEADSET

(71) Applicant: Safariland, LLC, Jacksonville, FL (US)

(72) Inventors: David Trinh Le, Irvine, CA (US); John Brad Medine, Chino, CA (US); Peter Hoang, Corona, CA (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 15/708,682

(22) Filed: Sep. 19, 2017

Related U.S. Application Data

(63) Continuation of application No. 29/582,974, filed on Nov. 1, 2016.

(51) Int. Cl.
*G10K 11/16* (2006.01)
*G10K 11/178* (2006.01)
*H04R 1/10* (2006.01)

(52) U.S. Cl.
CPC ..... *G10K 11/1786* (2013.01); *G10K 11/178* (2013.01); *G10K 11/1788* (2013.01); *H04R 1/1041* (2013.01); *H04R 1/1075* (2013.01); *G10K 2210/1081* (2013.01); *G10K 2210/3044* (2013.01); *H04R 2420/07* (2013.01)

(58) Field of Classification Search
CPC ..... G10K 11/1786; G10K 11/1788; G10K 2210/1081; G10K 2210/3044; G10K 11/178; H04R 1/1041; H04R 1/1075; H04R 2420/07
USPC ..... 381/17, 71.1, 71.6, 71.7, 71.8, 71.13, 381/73.1, 74, 309, 317; 455/569.1, 570, 455/575.2; 379/22.08, 430; 700/94
See application file for complete search history.

(56) References Cited

U.S. PATENT DOCUMENTS 4,455,675 A 6/1984 Bose et al.
4,644,581 A 2/1987 Sapiejewski
5,732,143 A * 3/1998 Andrea ..... G10K 11/178 381/71.13

(Continued)

OTHER PUBLICATIONS

What is the difference between a compressor, limiter, and a soft clipper? (https://www.quora.com/What-is-the-difference-between-a-compressor-limiter-and-a-soft-clipper).

(Continued)

*Primary Examiner* — Vivian Chin
*Assistant Examiner* — Friedrich W Fahnert
(74) *Attorney, Agent, or Firm* — Kane Kessler, P.C.; Paul E. Szabo

(57) ABSTRACT

A hearing protection headset that can be worn by a user includes left and right earcups. The headset includes a radio communication system enabling at least one radio signal to be received and played through one or both of the earcups. Noise control circuitry in the headset is configurable by a user between at least three active modes of operation—the circuitry having a first active mode in which the headset provides automatic noise reduction, a second active mode in which the headset provides automatic noise cancellation, and a third active mode in which the headset provides both automatic noise reduction and automatic noise cancellation. A switch is manually operable by the user to configure the circuitry between the first active mode and the second active mode and the third active mode.

11 Claims, 5 Drawing Sheets

(56) References Cited

U.S. PATENT DOCUMENTS

| | | | | |
|---|---|---|---|---|
| 6,597,792 | B1 | 7/2003 | Sapiejewski et al. | |
| 6,831,984 | B2 | 12/2004 | Sapiejewski | |
| 7,260,231 | B1 * | 8/2007 | Wedge | H04R 3/00 381/17 |
| RE45,151 | E | 9/2014 | Sapiejewski | |
| 2006/0153394 | A1 | 7/2006 | Beasley | |
| 2008/0080705 | A1 * | 4/2008 | Gerhardt | H04M 1/6066 379/430 |
| 2013/0129106 | A1 * | 5/2013 | Sapiejewski | H04R 1/105 381/71.6 |
| 2014/0126734 | A1 * | 5/2014 | Gauger, Jr. | H04R 3/002 381/71.6 |
| 2015/0296061 | A1 * | 10/2015 | Geiger | H04M 1/0258 348/14.12 |
| 2017/0075422 | A1 * | 3/2017 | Sun | H04R 1/1041 |
| 2017/0193978 | A1 * | 7/2017 | Goldman | G10K 11/1784 |
| 2017/0230744 | A1 * | 8/2017 | Schrader | H04R 1/1041 |

OTHER PUBLICATIONS

How Bose developed the noise-cancelling headphone, IndiaTechonline.com, http://www.indiatechonline.com/special-feature.php?id=240.

Can active noise cancelling improve speech intelligibility even in a single-ear headset? By Horst Gether, Product Manager, ams AG, www.ams.com/anc.

* cited by examiner

MULTI PROFILE HEARING PROTECTION HEADSET

RELATED APPLICATIONS

This application claims priority to U.S. Design patent application Ser. No. 29/582,974, filed Nov. 1, 2016, the entire disclosure of which is incorporated by reference.

BACKGROUND OF THE INVENTION

This invention relates to a hearing protection device. In particular, this invention relates to a hearing protection headset that uses electronic noise compression, filtering, and enhancement technology. The headset can be used in law enforcement and sport applications, and also in industrial and commercial markets. A hearing protection headset has a primary function to control external sounds, amplifying some sounds and limiting the amplitude of other sounds. As a second function, the headset can enable radio communications.

The headset earcups block low-level ambient sounds, to a point at which it becomes difficult to hear sounds that are needed or desired to be heard. So, those sounds need to be amplified. At the same time, the user does not want to be exposed to a loud and potentially damaging sound of, for example, a gunshot or equipment.

SUMMARY OF THE INVENTION

A headset of the present invention has three active modes of operation. The first active mode is automatic noise cancellation. The second active mode is automatic noise reduction. The third active mode is simultaneous automatic noise cancellation and automatic noise reduction. With the third active mode, the user is able to filter out selected ambient sounds, control the amplitude of other ambient sounds, and be protected against overly loud sounds, all at the same time. A fourth or passive mode is with the system turned off, relying on only the earmuffs to block sound.

The invention allows the user to select among these different pre-programmed frequency processing profiles. The signal processing technologies provide opportunities to improve situational awareness for users. As one example, if a user's mission includes helicopter operation (an overall noisy environment) followed by stealth movement (in a quiet environment), the user can select noise cancellation while in the helicopter, then change to (or add) ambient sound enhancement with simultaneous gunshot reduction while on the ground.

BRIEF DESCRIPTION OF THE DRAWINGS

Further features of the invention will become clear to one of ordinary skill in the art to which the invention pertains, from a reading of the following description together with the accompanying drawings, in which.

DETAILED DESCRIPTION

Figure 1:
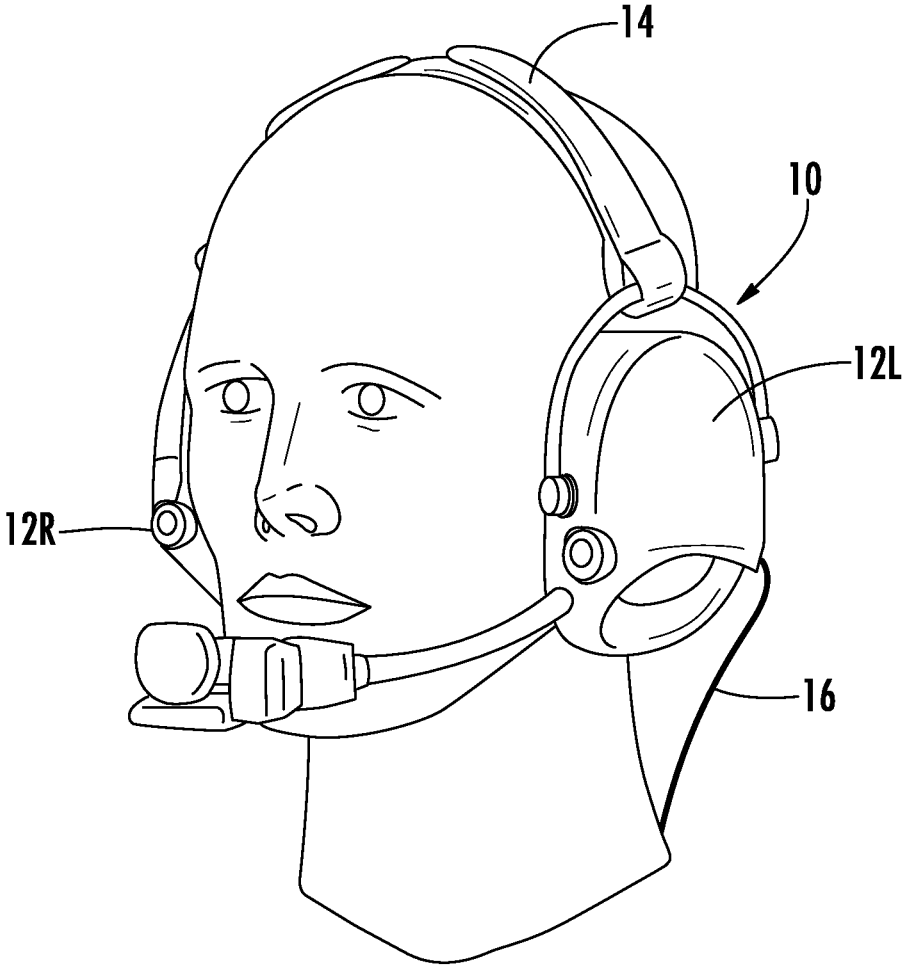
FIG. 1 is a pictorial view of a headset that is a first embodiment of the invention.

The present invention relates to a hearing protection device. In particular, the present invention relates to a hearing protection device in the form of a headset. The invention is applicable to different types of headsets. As representative of the invention, FIG. 1 illustrates a headset 10 that is a first embodiment of the invention.

The headset 10 includes a left earcup 12L, a right earcup 12R, and a band or other structure 14 connecting the earcups so that the headset can be worn by a user. The headset 10 includes a communications connector (cable) 16 for enabling electrical connection to a radio system such as a push to talk unit. In this application, the earcups 12L and 12R are the same as (or mirror images of) each other, therefore, only one earcup (designated hereafter as "the earcup 12" with its associated parts) will be described. As is described below, the headset 10 may be of the type that is capable of providing radio communications to the user over one or two separate channels, to the left and/or right earcups 12L and 12R.

The earcup 12 (FIG. 2) has a generally standard physical construction including a shell 20 and a foam pad 22 defining a sound chamber 24 that encompasses the user's ear. An external microphone indicated schematically at 26 is located on the shell of the earcup 12. This may be an electret microphone and is used for picking up ambient sound around the user, outside of the earcup 12. Preferably the external microphone 26 is located behind or within a body of acoustic foam 28 to minimize wind noise.

A printed circuit board indicated schematically at 30 is mounted inside the sound chamber 24 of the earcup 12. The PC board 30 contains some of the electrical circuitry for the headset 10 including the earcup 12, preferably including the noise control circuitry 11. There are two speakers mounted on the PC board. The first speaker 32 is used for radio and other similar communications such as music, etc. The second speaker 34 is used for the sound control system-enhancement and suppression of ambient sound.

Figure 2:
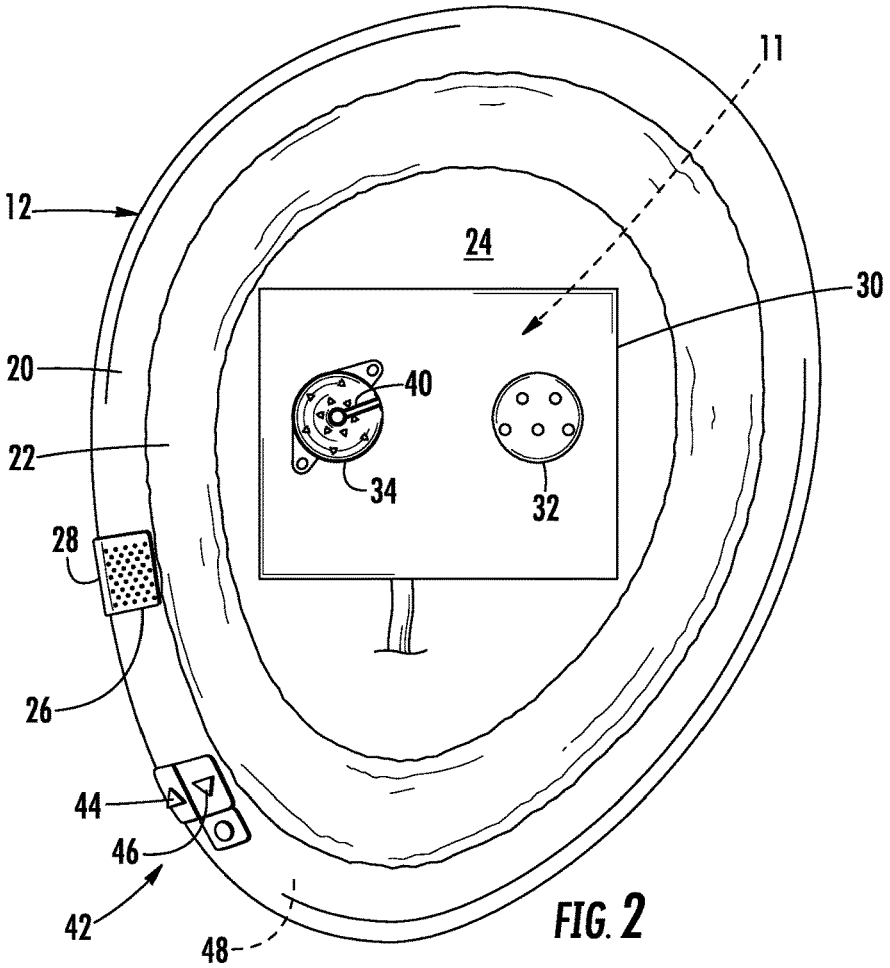
FIG. 2 is an enlarged schematic view of an earcup that forms part of the headset of FIG. 1.
Figure 3:
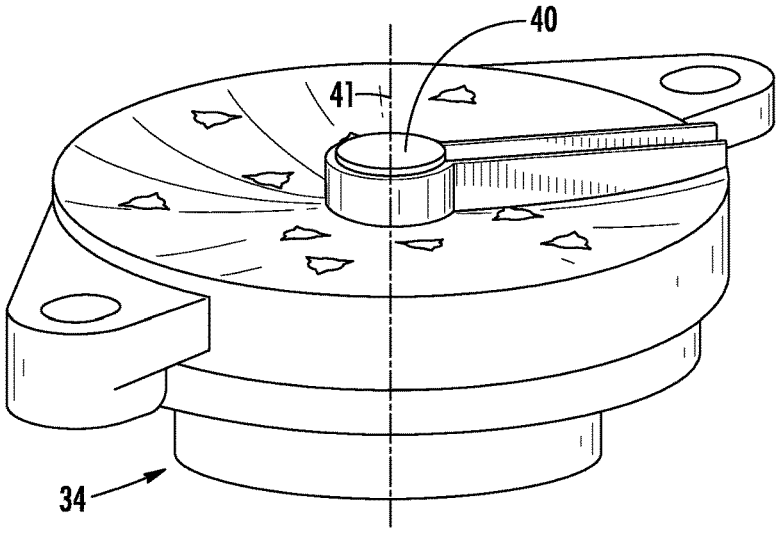
FIG. 3 is an enlarged perspective view of an internal speaker and microphone that is located in the earcup of FIG. 2.

An internal microphone shown schematically at 40 in FIGS. 2 and 3 is mounted on the center of the speaker enclosure of the second speaker 34. The internal microphone 40 may pick up some ambient (external) sound that gets through the earcup 12 into the sound chamber 24. However, the internal microphone 40 is primarily used with and as part of the sound control system 11, getting feedback from its associated speaker 34.

FIG. 3 is another view of the internal microphone 40 as mounted on the second speaker 34. The microphone 40 is pointed perpendicularly toward the diaphragm of the speaker 34 and is mounted on the axis 41 of the speaker. Applicant has determined that this is the preferred method for obtaining the feedback results desired for the automatic noise cancellation feature, An on/off volume control switch assembly indicated schematically at 42 may be mounted on the earcup 12, in a location that the user can access by hand. In the illustrated embodiment, the switch assembly 42 includes a volume up switch 44 and a volume down switch 46 for raising or lowering volume. In addition, the two switches 44 and 46 are coupled electrically, in a manner as described below, so that pressing and holding both switches simultaneously can control the mode of the noise control circuitry 11.

Figure 4:
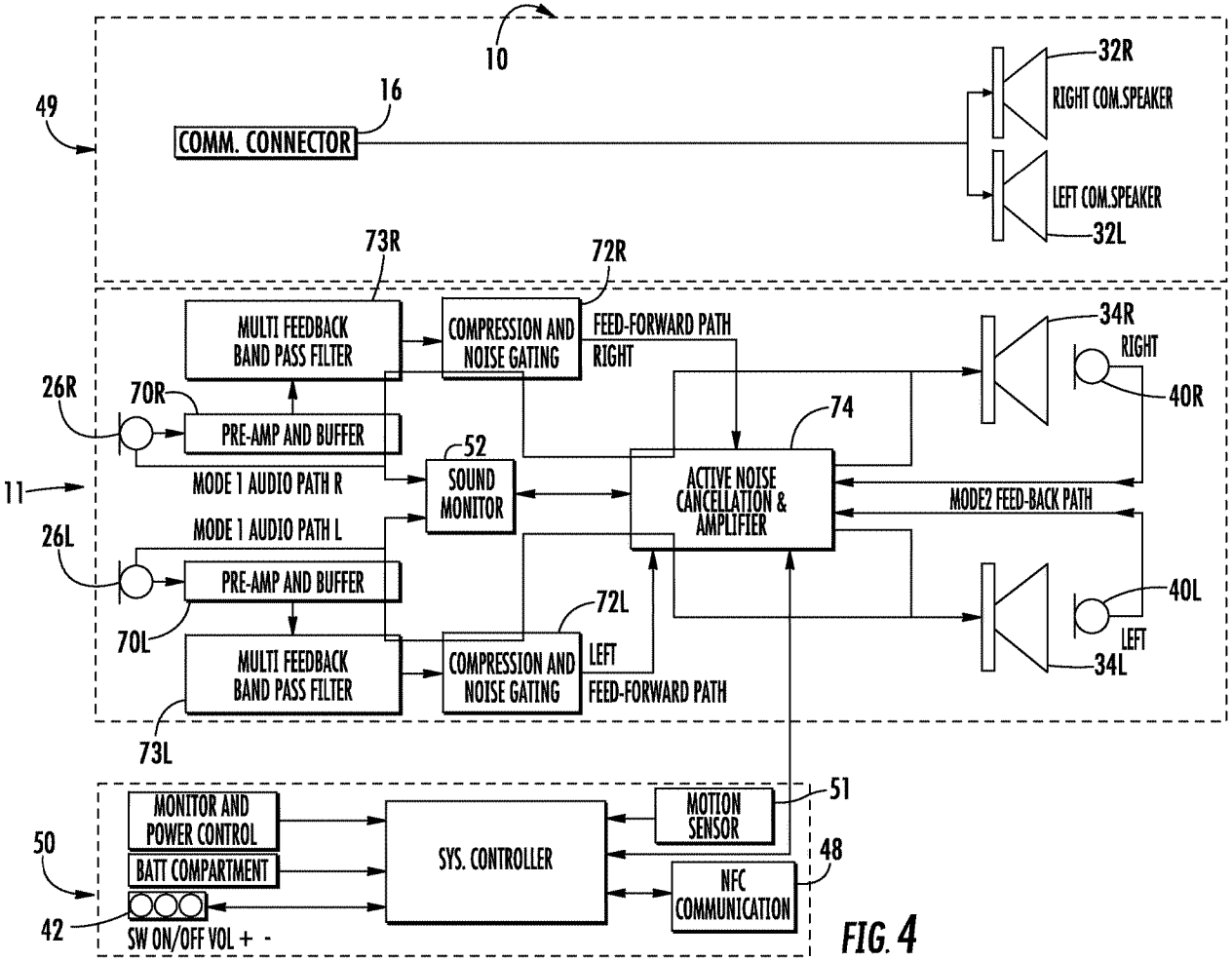
FIG. 4 is a block diagram of the electrical circuitry of the headset of FIG. 1.

The headset 10 may also include near field (wireless) communication components ("NFC"), indicated schematically at 48 in FIG. 4, including a wireless receiver to enable updating the ANC and/or ANR parameters in the firmware of the headset. A user can utilize a smartphone, or a personal computer, or any NFC reader/writer device to modify the defined active noise cancellation and/or active noise reduction parameters as desired.

The headset 10 may also include a motion sensor indicated schematically at 51. A preferred sensor is a three-axis "nano" accelerometer integrated circuit (IC) provided from ST Micro Electronics, for example model LIS3DSHTR, to provide headset motion (or activity) data to the system controller. By combining this information with internal timer and motion data, the system controller can determine when the headset is not in usage, and deactivate it that time (terminate its operation) to conserve battery power. For example, the system controller could turn off other components or put them into a deep sleep mode.

When the headset is in motion, the motion sensor 51 would then pull the system controller out of deep sleep mode via interrupted routine in the firmware of the system controller. Thus: the motion sensor 51 would activate the operation of the headset 10 when the headset is in motion. Additionally, the user can activate the headset 10 from deep sleep mode by turning the headset on with the power on switch.

The system controller also monitors the ambient sound level via the external microphones 26L and 26R, comparing with programmed parameters, to determine the optimum mode of operation.

The noise control circuitry 11 of the headset 10 is shown in block diagram form at FIG. 4. The circuitry 11 is configurable by the user between at least three active modes of operation, as described below in detail. Specifically, the circuitry 11 has a first active mode in which the headset 10 provides automatic noise reduction only; a second active mode in which the headset provides automatic noise cancellation only; and a third active mode in which the headset provides both automatic noise reduction and automatic noise cancellation.

In this application, "automatic noise reduction" is a form of active noise control, carried out via electrical circuitry, in which ambient sound is allowed to be presented to the user while limiting its overall amplitude so as to protect the user's hearing. This feature provides the user with situational awareness by enabling the user to hear ambient sounds, while protecting the user's hearing from overly loud sounds such as heavy machinery or a gunshot.

In this application, "automatic noise cancellation" is a form of active noise control in which selected ambient sounds, that may be repetitive, are filtered out so that other sounds, such as radio communications, can be heard more clearly. As one example, a user riding in a helicopter may configure the circuitry to attenuate the repetitive sound of the helicopter engine and rotor while not attenuating desirable sounds such as speech and audible warning signals.

In this application, "passive noise control" occurs with the electrical circuitry 11 turned off (or otherwise set to provide neither automatic noise reduction nor automatic noise cancellation), relying on only the earcups 12L and 12R to physically block sound.

FIG. 4 illustrates schematically the independent communications section 49 of the headset 10. This section 49 of the headset 10 includes the first speaker 32L in the left earcup 12L, and the first speaker 32R in the right earcup 12R. The communications connector 16 provides audio signals to the first speakers 32L and 32R. The first speakers 32L and 32R are used primarily for radio communications and the like, and are not used for noise control.

FIG. 4 also illustrates schematically the power and control section (system control section) 50 of the headset 10. The section 50 includes the on/off volume control switch assembly 42 which as noted above may be mounted on one of the earcups 12 or which may be mounted separately, for example, in a push to talk assembly. In the illustrated embodiment, the switch assembly 42 includes the volume up switch 44 and the volume down switch 46 for raising or lowering volume. In a preferred embodiment, the two switches 44 and 46 are coupled electrically in a manner so that pressing and holding both switches simultaneously can control (switch between) the modes of the noise control circuitry 11. The power and control section 50 of the headset circuitry also includes the near field communication component 48 to enable updating of the firmware in the headset 10.

The power and control section 50 also includes the system controller. This is a digital chip with a flash memory that is programmable. The three different configuration parameters, or active modes of operation of the noise control circuitry 11, are stored in this digital medium such as Flash EEROM.

The noise control circuitry 11 includes the left and right external microphones 26L and 26R, which may be electret microphones. As noted above, the external microphones 26L and 26R are located on the outside of the headset 10, one on each earcup 12, so as to pick up ambient sound and feed it into the noise control circuitry 11.

Each external microphone 26 feeds its output into a respective preamplifier 70 and then into a compression and noise gating unit 72. The outputs of the two compression and noise gating units 72 are sent to a single controller 74. The output of the controller 74 is sent to the left and right second speakers 34 L and 34R, respectively, which are mounted in the earcups 12L and 12R, adjacent to the first speakers 32L and 32R.

The noise control section 11 of the circuitry also includes the left and right internal microphones 40 that are mounted on the left and right second speakers 34, respectively. Each one of the internal microphones 40 picks up sound from its associated second speaker 34. The outputs of the internal microphones 40 are fed to the controller 74.

Figure 5:
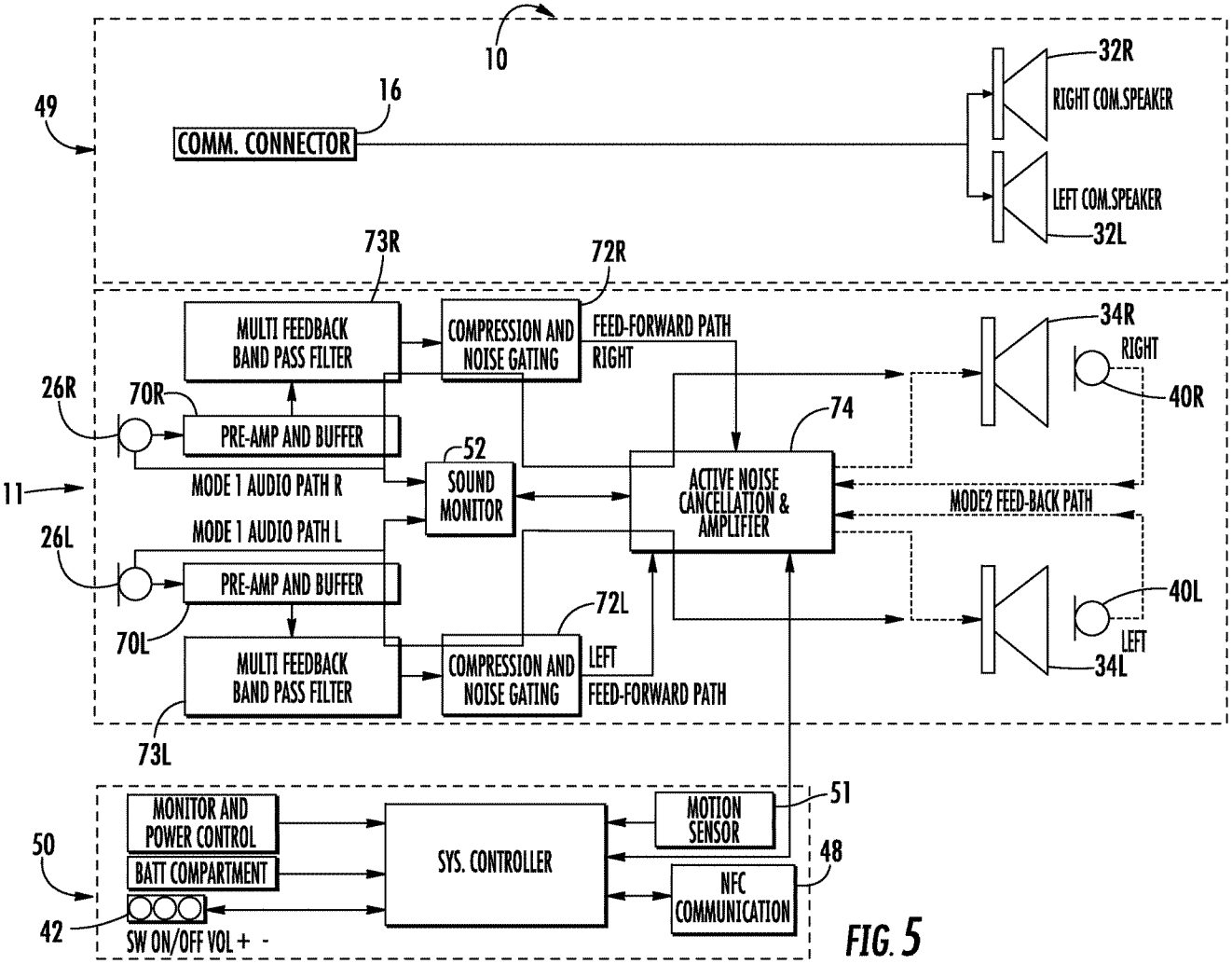
FIG. 5 is the block diagram of FIG. 4 with a first sound flow path highlighted.
Figure 6:
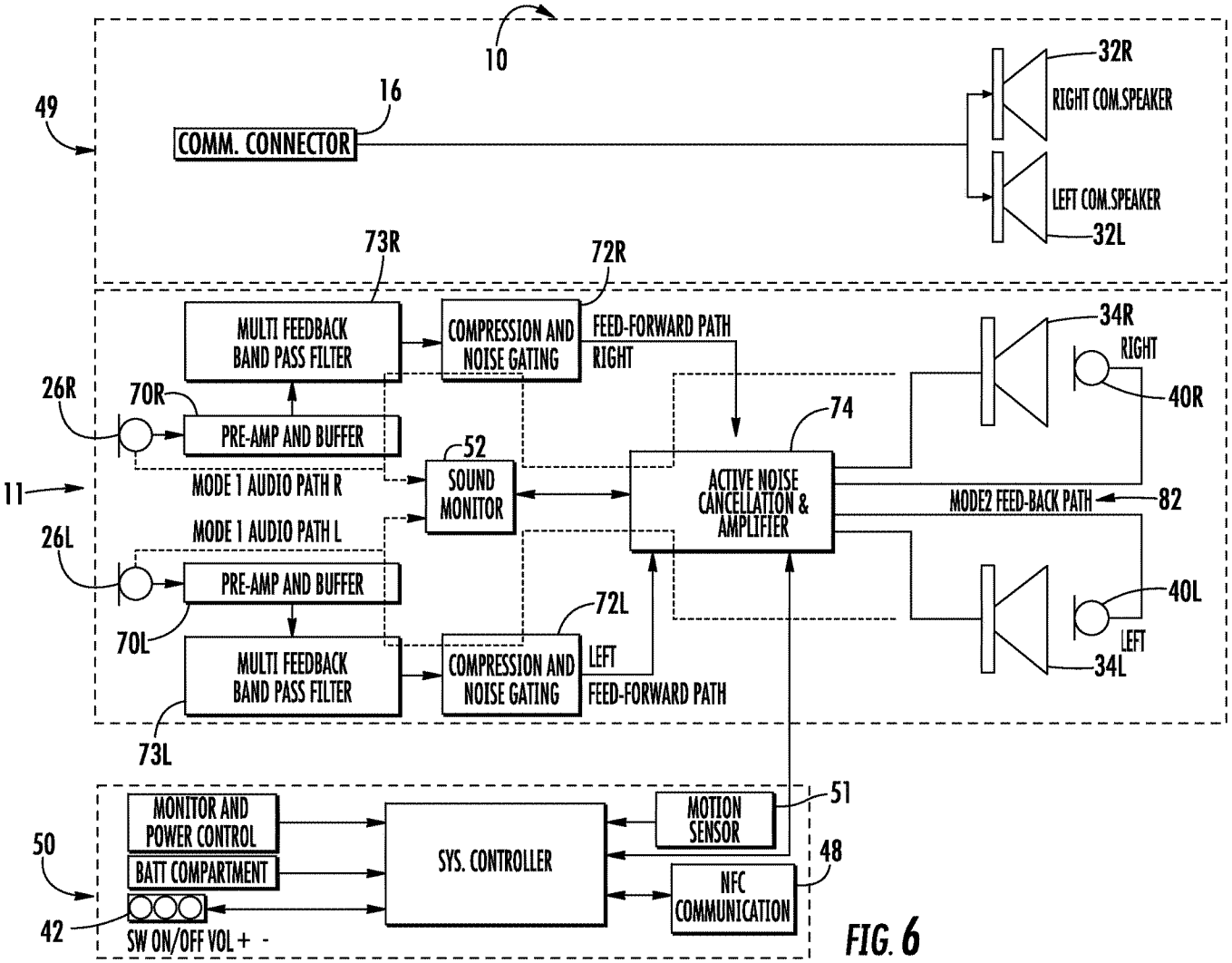
FIG. 6 is a view similar to FIG. 5 with a second sound flow path highlighted.

In sum, the circuitry can be said to include generally two audio paths. The first audio path 80 is shown in solid lines in FIG. 5 and is a feed forward path including the external microphone 26; the preamplifier 70; the compression and noise gating unit 72; the controller 74; and the second speaker 34. The second audio path 82 (for each of the left and right channels) is shown in solid lines in FIG. 6 and is a feed back path including the second speaker 34, the internal microphone 40, and the controller 74.

The radio communication system 49 may be configured to receive two different channels of signals, such that when both channels have incoming signals one signal is sent to the left earcup 12L and the other signal is sent to the right earcup 12R, but if only one channel has an incoming signal that one signal is sent to both earcups of the headset 10. This feature is described in Applicant's co-pending U.S. application Ser. No. 15/163,936 filed May 25, 2016, the entire disclosure of which is hereby incorporated by reference.

As noted above, the noise control circuitry 11 can be configured into a first mode, in which ambient sound is input through an external microphone and then presented to the user via the second speakers, subject to an automatic noise reduction operation.

In this mode, using the left channel as an example, the left external microphone 26L is mounted in a special chamber on the outside of the earcup 12L inside of some acoustic foam 28L that filters out wind noise. The microphone 26L picks up ambient sound. The output of the microphone 26L is fed into the preamplifier (preamp) 70L.

The performance of the preamp 70L is set so that external sounds with a very low are amplified to a level at which they will be come audible to the user when played back through the second speaker 34L. This enables the user to maintain situational awareness by enhancing low-level sounds. In one embodiment, two separate gain levels are provided, the first gain level being 3.9 and the second level being around 100 times the first stage.

At this point a bandpass filter 73 is also provided to cut off any sound over 33 KHz in frequency. This filter prevents any RF interferences from being input via the microphones 26L and 26R The amplification night increase the volume of some external sounds to an undesirably high level. Therefore, the output of the preamp 70L is sent to the compression and gating unit 72L. In this unit 72L, harmful sound levels are reduced. One chip that may be used is Analog Device semiconductor model SSM2167-1RMZ-R7. The limit threshold can be selected during manufacture, and can be modified thereafter as desired. In this instance, a significant amount of trial and error testing was required. All environmental conditions in which the headset might be used were also tested to determine appropriate characteristics.

This single chip analog solution IC 72L provides a flexible and low cost solution for audio conditioning to satisfy all requirements for tactical headset application. For example, it could be used for limiting the gunshot sound or any similar harmful sound level. In order to do so, from experimental conditions, applicant selected the limit threshold (or rotating point) from the external passive component. This section is important to the noise control circuitry 11.

The output of the compression and gating unit 72L is sent to the controller 74. In one embodiment, the controller 74 is an AS3435 chipset from AMS. This unit includes the speaker drivers for the second speakers 34L and 34R. This unit is believed to be the only one available in the marketplace that can utilize an analog ANC topical solution (analog is much lower power draw, as is desired for a battery-operated headset). When the headset 10 is in the first mode, the ANC feature is disabled, and automatic noise reduction is provided instead.

As a result, and as one non-limiting example, the headset 10 can be used in the first mode at a gun range. The noise control circuitry 11 reacts quickly to high amplitude sounds—the gunshot is sudden and loud. The sound of the gunshot is filtered and compressed by the unit 72, down to a safe decibel level, under the parameters set by the system controller. For example, if the sound level is 130 decibels at the outside of the headset 10 (the external microphone 26L), then the circuitry 11 may reduce it to 85 decibels before the sound is provided to the user's ears through the earcup 12L As another example, this is the type of active noise protection device that is needed by a soldier or law enforcement officer on the ground-so that the solider is able to hear well around him, while safe from gunshots. If, for example, an officer is positioned outside a window of a house, listening to low level sounds, it is important to prevent hearing damage from a sudden gunshot. The ANR of mode 1 of the headset 10 can accomplish this. The officer can easily switch to ANR as desired.

In some cases, the first active mode is needed, for example, when a soldier is riding in a helicopter to reach station. In that type of situation, the soldier needs to be able to hear oral communications, while avoiding (if possible) the repetitive mechanical sounds of the operating helicopter. To that tend, the noise control circuitry 11 of the headset 10 can alternatively be configured into the second mode, in which sound is input to the controller 74 through an internal microphone 40 and then presented through the second speakers 34, subject to an automatic noise cancellation operation.

Specifically, and as noted above, the noise control circuitry 11 also includes the left internal microphone 40L that is mounted on the left second speaker 34L, and a right internal microphone 40R that is mounted on the right second speaker 34R. Each one of the internal microphones 40 picks up sound from its associated second speaker 34. The outputs of the internal microphones 40 are fed to the controller 74 which eliminates selected sounds.

The controller 74 utilizes an analog solution during Active Noise Cancellation (ANC) to provide an advantage of longer operational battery life which can be important in a tactical environment. Values for this active noise cancellation are calculated from the headset earcup sound chamber 24 and its acoustic characteristics and response to the low frequencies. Tools are provided from AMS. These are stored in the flash memory of the system controller and are provided to the MCU 74. In Mode 1, the audio in the feedback path is disabled via the control code sent to the ANC IC AS3435 via a 2 wire communication BUS 12C (Inter-IC protocol) from the system controller.

The noise control circuitry 11 can alternatively be configured into a third mode. The third mode is a combination of both the first mode and the second mode. In the third mode, the benefits of both automatic noise reduction and automatic noise cancellation are obtained simultaneously.

Specifically, by using the volume up and volume down switches 44 and 46 in a particular combination and manner, both the ANR and ANC effects can be provided. Accordingly, a user can operate at an advantage in an environment with superior portable radio communication while providing both reliable hearing protection (ANR) and situational awareness (ANC). The headset 10 will safely reduce hazardous noise while enhancing low-level sounds.

This combination of the first active and the second active together creates a new operation that allows a users to listen to all conditions in a tactical environment with very low unwanted noise and in comfort as to volume levels. This is mode 3 of the headset 10. Gain values of the ANC must be adjusted/tuned based on the new conditions. This tuning prevents the feedback and feedforward (ANC/ANR) from becoming overloaded and/or oversaturating the internal amplifiers. We obtained all parameter from AMS tools such as development kit and its simulation software to simulate with our ear-cups accordingly.

In accordance with another feature of the invention, the headset 10 may include an automatic sound monitor shown schematically at 52 in FIG. 4. In accordance with this feature, ambient sound is monitored and compared with available data in firmware. The current operational mode (1, 2, or 3) of the noise control circuitry 11 is sensed. The sound monitor 52 then automatically (without user intervention) switches to the desired mode of operation of the noise control circuitry 11, to ensure that the headset 10 functions optimally. This automatic sound monitor feature may be switched on or off as desired, by the user.

Specifically, the headsets firmware is programmed with parameters indicative of many different ambient sound situations. The monitor 52 can sense, using the outputs of the external microphones, whether there is repetitive noise that should be cancelled, for example, the sound of helicopter engines or rotors. The monitor 52 can sense whether there is high amplitude (and/or instantaneous) noise that should be cancelled, for example, the sound of gunshots. Thus, if the monitor 52 senses that there is a large amount of repetitive noise, and not much high amplitude sound, the system will be placed into Mode 2, automatic noise cancellation only. In contrast, if the monitor 52 senses not much repetitive noise but a significant amount of high amplitude sounds, then the system will be placed into Mode 1, automatic noise reduction only. If the monitor 52 senses both repetitive noise an high amplitude sounds, the system will be placed into Mode 3, obtaining both automatic noise reduction and automatic noise cancellation. Amplitudes, specific sounds, etc., can all be programmed into the firmware of the monitor 52. Many other different variations are possible other than these non-exclusive examples.

Again, all this firmware, containing the information and data needed to make these decisions, can be changed and programmed wirelessly via the near field communication capability 48 of the headset 10. Ambient Mode 1 (automatic noise reduction) is preferably selected as the default mode, for safety of the user.

Finally, the noise control circuitry 11 can be turned off, providing a fourth mode of operation in which the user hears only radio communications and also hears unmodified external sounds entering the earcup sound chamber 24 vi the structure of the earcups 12L and 12R themselves.

The invention claimed is:

1. A hearing protection headset that can be worn by a user, the headset including left and right earcups, the headset including:

a radio communication system enabling at least one radio signal to be received and played through one or both of the earcups;

a noise control circuitry configurable by a user between at least three active modes of operation involving one or both of (i) automatic noise reduction that limits the overall amplitude of ambient sound and (ii) automatic noise cancellation which filters out selected repetitive sounds so that non-repetitive sounds can be heard more clearly;

the circuitry having a first active mode in which the headset provides the automatic noise reduction but does not provide the automatic noise cancellation, a second active mode in which the headset provides the automatic noise cancellation but does not provide the automatic noise reduction, and a third active mode in which the headset provides both the automatic noise reduction and the automatic noise cancellation; and a switch that is manually operable by the user to configure the circuitry between the first active mode and the second active mode and the third active mode, wherein:

each earcup includes (i) a first speaker for use in radio communications and not used in the noise control circuitry, (ii) a second speaker that is part of the noise control circuitry and that is not used in radio communications, and (iii) an internal microphone that is part of the noise control circuitry and that is mounted on the second speaker;

the second speaker and the internal microphone being active for the automatic noise cancellation operation when the circuitry is in either the second mode or the third mode;

the second speaker being active and the internal microphone being inactive for the automatic noise reduction operation when the circuitry is in the first mode.

2. A headset as set forth in claim 1 wherein the second speaker has a round diaphragm and the internal microphone is mounted on the central axis of the diaphragm of the second speaker and faces perpendicularly toward the diaphragm.

3. A headset as set forth in claim 1 wherein the circuitry when operating in the automatic noise cancellation mode has a feedback path including the second speaker and the internal microphone and a controller.

4. A headset as set forth in claim 1 wherein the circuitry when operating in the automatic noise reduction mode has a feed forward path including an external microphone, a preamplifier, a compression and noise gating unit, the controller, and the second speaker.

5. A headset as set forth in claim 3 wherein the controller is an analog chip that provides analog automatic noise cancellation operation;

the noise control circuitry further includes a digital system controller in addition to the analog controller, the digital system controller being programmable with parameters of the operation of the noise control circuitry for both the automatic noise cancellation and the automatic noise reduction; and the noise control circuitry further includes an analog compression and gating unit that is active in the automatic noise reduction.

6. A hearing protection headset that can be worn by a user, the headset including left and right earcups, the headset including:

a radio communication system enabling at least one radio signal to be received and played through one or both of the earcups;

a noise control circuitry configurable by a user between at least three active modes of operation involving one or both of (i) automatic noise reduction that limits the overall amplitude of ambient sound and (ii) automatic noise cancellation which filters out selected repetitive sounds so that non-repetitive sounds can be heard more clearly;

the circuitry having a first active mode in which the headset provides the automatic noise reduction but does not provide the automatic noise cancellation, a second active mode in which the headset provides the automatic noise cancellation but does not provide the automatic noise reduction, and a third active mode in which the headset provides both the automatic noise reduction and the automatic noise cancellation; and a switch that is manually operable by the user to configure the circuitry between the first active mode and the second active mode and the third active mode;

wherein the headset monitors the ambient sound level via the external microphones and compares with programmed parameters to determine the optimum mode of operation.

7. A headset as set forth in claim 6 that monitors the need for t automatic noise cancellation only and for the automatic noise reduction and that automatically switches between those two modes, or into the third mode with both the automatic noise reduction and the automatic noise cancellation, based on programmed parameters that can be updated wirelessly via near field communication.

8. A hearing protection headset that can be worn by a user, the headset including left and right earcups, the headset including:

a radio communication system enabling at least one radio signal to be received and played through one or both of the earcups;

a noise control circuitry configurable by a user between at least three active modes of operation involving one or both of (i) automatic noise reduction that limits the overall amplitude of ambient sound and (ii) automatic noise cancellation which filters out selected repetitive sounds so that non-repetitive sounds can be heard more clearly;

the circuitry having a first active mode in which the headset provides the automatic noise reduction but does not provide the automatic noise cancellation, a second active mode in which the headset provides the automatic noise cancellation but does not provide the automatic noise reduction, and a third active mode in which the headset provides both f automatic noise reduction and, automatic noise cancellation; and a switch that is manually operable by the user to configure the circuitry between the first active mode and the second active mode and the third active mode;

wherein each earcup includes (i) a first speaker for use in radio communications but not in noise control, (ii) a second speaker that is part of the noise control circuitry and that is not for use in radio communications, and (iii) an internal microphone that is part of the noise control circuitry and that is mounted on the second speaker;

the second speaker and the internal microphone both being active for the automatic noise cancellation operation when the circuitry is in either the second mode or the third mode;

the second speaker being active and the internal microphone being inactive for the automatic noise reduction operation when the circuitry is in the first mode;

a controller;

the circuitry when operating in the automatic noise reduction mode having a feed forward path including an external microphone, a preamplifier, a compression and noise gating unit, an analog controller, and the second speaker, and not including the internal microphone;

the circuitry when operating in the automatic noise cancellation mode having a feedback path including the second speaker and the internal microphone and the controller, and not including the external microphone, the preamplifier, and the compression and noise gating unit.

9. A headset as set forth in claim 8 wherein the radio communication system is configured to receive two different channels of signals, such that when both channels have incoming signals one signal is sent to the left earcup and the other signal is sent to the right earcup, but if only one channel has an incoming signal that one signal is sent to both earcups of the headset.

10. A headset as set forth in claim 8 wherein the controller is an analog chip that provides analog automatic noise cancellation operation;

the noise control circuitry further includes a digital system controller in addition to the analog controller, the digital system controller being programmable with parameters of the operation of the noise control circuitry for both the automatic noise cancellation and the automatic noise reduction; and the compression and gating unit is an analog chip that is active in automatic noise reduction.

11. A headset as set forth in claim 8 including;

near field communication capability to enable wireless changing of noise control circuitry parameters for the active noise cancellation and/or the active noise reduction;

a motion sensor for determining when the headset is not in use and deactivating it accordingly to conserve battery power; and wherein the headset monitors the ambient sound level via the external microphones and compares with programmed parameters to determine the optimum mode of operation.

* * * * *